US006670876B2

(12) United States Patent
Gruson

(10) Patent No.: US 6,670,876 B2
(45) Date of Patent: Dec. 30, 2003

(54) ELECTROMAGNETIC ACTUATOR HAVING A PERMANENT MAGNET

(75) Inventor: Bertrand Gruson, Breville sur Mer (FR)

(73) Assignee: Serac Group, La Ferte Bernard (FR)

( * ) Notice: Subject to any disclaimer, the term of this patent is extended or adjusted under 35 U.S.C. 154(b) by 0 days.

(21) Appl. No.: 10/413,392

(22) Filed: Apr. 15, 2003

(65) Prior Publication Data

US 2003/0197582 A1 Oct. 23, 2003

(30) Foreign Application Priority Data

Apr. 22, 2002 (FR) ..... 02 04988

(51) Int. Cl.[7] ..... H01F 3/00; H01F 7/08
(52) U.S. Cl. ..... 335/229
(58) Field of Search ..... 335/177–184, 335/229–234, 255–282

(56) References Cited

U.S. PATENT DOCUMENTS 4,295,111 A 10/1981 Wang ..... 335/256

FOREIGN PATENT DOCUMENTS

WO WO 01/40098 6/2001

*Primary Examiner*—Ramon M. Barrera
(74) *Attorney, Agent, or Firm*—Young & Thompson

(57) ABSTRACT

The electromagnetic actuator comprises a coil, a magnetic actuator member mounted in the coil, at least one ring of magnetic material placed around the coil, and at least one permanent magnet adjacent to one end of the ring and disposed overlying a portion of the outside surface of the coil, the permanent magnet having a magnetic field that extends in an axial direction of the coil, the magnetic actuator member being slidably mounted in a non-magnetic guide member extending inside the coil, and the ring having an end opposite from the magnet which is spaced apart from the non-magnetic guide member by a non-magnetic gap.

3 Claims, 1 Drawing Sheet

ELECTROMAGNETIC ACTUATOR HAVING A PERMANENT MAGNET

The present invention relates to an electromagnetic actuator having a permanent magnet.

BACKGROUND OF THE INVENTION

Document U.S. Pat. No. 4,295,111 discloses an electromagnetic actuator comprising a coil placed around a magnetic body in which a magnetic actuator member is mounted. A permanent magnet is placed around the coil and has a magnetic field extending along an axial direction of the coil.

The permanent magnet is interposed between two rings of magnetic material which are in contact with the magnetic body. This serves to concentrate the magnetic field and to develop a high level of force. In contrast, the stroke of the actuator member is relatively short, and for long strokes, it is necessary to increase the axial dimensions of the actuator.

OBJECT AND SUMMARY OF THE INVENTION

The invention provides an electromagnetic actuator comprising a coil, a magnetic actuator member mounted in the coil, at least one ring of magnetic material placed around the coil, and at least one permanent magnet adjacent to one end of the ring and disposed overlying a portion of the outside surface of the coil, the permanent magnet having a magnetic field that extends in an axial direction of the coil, the magnetic actuator member being slidably mounted in a non-magnetic guide member extending inside the coil, and the ring having an end opposite from the magnet which is spaced apart from the non-magnetic guide member by a non-magnetic gap.

Thus, instead of being totally looped, a portion of the magnetic field remains open so that the stroke of the magnetic actuator member is lengthened. It is then possible to control the position of the magnetic actuator member by appropriately controlling the power supply to the coil.

BRIEF DESCRIPTION OF THE DRAWING

Other characteristics and advantages of the invention appear on reading the following description of a particular, non-limiting embodiment of the invention given with reference to the sole accompanying FIGURE which is an axial section view of an electromagnetic actuator of the invention.

MORE DETAILED DESCRIPTION

Figure 1:
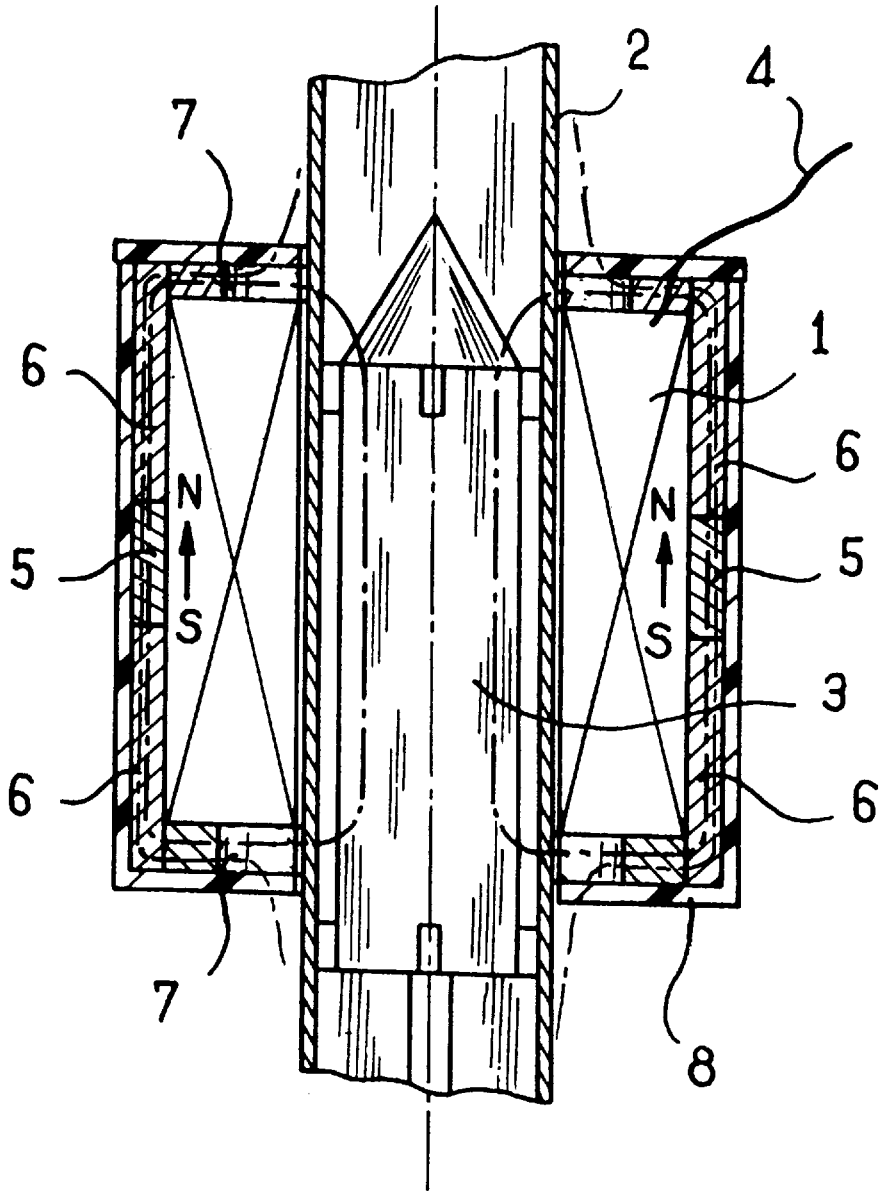

With reference to the FIGURE, the electromagnetic actuator of the invention comprises in conventional manner: a coil 1 fixed around a tube of non-magnetic material 2 in which a magnetic actuator member 3 is slidably mounted. The coil 1 is connected by a power supply wire 4 to power supply means (not shown) enabling the coil to be excited or de-excited in order to drive the magnetic actuator member.

In accordance with the invention, in the preferred embodiment shown, a ring 5 forming a permanent magnet, e.g. a ferrite ring whose permanent magnetic field extends in an axial direction of the ring, is placed around the coil so as to overlie the central portion of the outside surface of the coil. The field generated by the ring 5 thus extends in an axial direction of the coil 1. The ring 5 is disposed between two rings 6 of magnetic material, e.g. of soft iron.

In addition, the two ends of the coil 1 are covered by annular plates 7 each having a peripheral edge in contact with the inside surface of the corresponding ring 6. The annular plates 7 are pierced by respective central orifices of diameter greater than the diameter of the non-magnetic tube 2. The magnetic rings 6 are thus spaced apart from the non-magnetic tube 2 by a non-magnetic gap.

The assembly is surrounded by an insulating casing 8, e.g. a molded casing which serves to hold the rings and the end plates in place.

A fraction of the field lines that result from the permanent magnet 5 extend around a loop as shown in fine chain-dotted lines in the FIGURE so that even in the absence of any power supply to the coil, as shown in the FIGURE, the weight of the magnetic actuator member is compensated in part by the force of attraction that results from the permanent magnet. When the coil 1 is excited, it generates an additional magnetic field which moves the magnetic actuator member 3 upwards.

A fraction of the magnetic field lines escape through the non-magnetic gap so that the stroke of the actuator member is lengthened. In order to reduce or to increase the fraction of the magnetic field that remains unlooped, the non-magnetic gap should be decreased or increased in size by using an annular plate having a central orifice that is smaller or larger.

Naturally, the invention is not limited to the embodiment described and various embodiments can be applied thereto without going beyond the ambit of the invention as defined by the claims.

In particular, although the actuator of the invention is described as having plates of magnetic material 7 disposed at the ends of the coil, the actuator of the invention could be made without the plates 7. The magnetic plate 7 could also be replaced in full or in part by a plate of non-magnetic material.

Similarly, although the invention is shown in a symmetrical configuration of the rings of magnetic material 6 about the permanent magnet 5, the configuration of the assembly could be modified so as to obtain some particular behavior of the actuator as a function of the application for which the actuator is intended.

Although the invention is shown with a permanent magnet in the form of a ring, it is also possible to make an actuator of the invention by using a series of bar magnets disposed so as to overlie a portion of the outside surface of the coil 1.

Although the guide member is described as being in the form of a tube, it could be in some other form, for example it could be made in the form of slideways.

What is claimed is:

1. An electromagnetic actuator comprising a coil, a magnetic actuator member mounted in the coil, at least one ring of magnetic material placed around the coil, and at least one permanent magnet adjacent to one end of the ring and disposed overlying a portion of the outside surface of the coil, the permanent magnet having a magnetic field that extends in an axial direction of the coil, wherein the magnetic actuator member is slidably mounted in a non-magnetic guide member extending inside the coil, and wherein the ring has an end opposite from the magnet which is spaced apart from the non-magnetic guide member by a non-magnetic gap.

2. An electromagnetic actuator according to claim 1, wherein the permanent magnet is a ring surrounding the coil.

3. An electromagnetic actuator according to claim 1, wherein the permanent magnet is interposed between two rings of non-magnetic material.

* * * * *